US009516935B2

(12) United States Patent
Rorie

(10) Patent No.: US 9,516,935 B2
(45) Date of Patent: Dec. 13, 2016

(54) SHOE BAG

(71) Applicant: Sonya Y. Rorie, Charlotte, NC (US)

(72) Inventor: Sonya Y. Rorie, Charlotte, NC (US)

( * ) Notice: Subject to any disclaimer, the term of this patent is extended or adjusted under 35 U.S.C. 154(b) by 63 days.

(21) Appl. No.: 14/181,598

(22) Filed: Feb. 14, 2014

(65) Prior Publication Data

US 2015/0230574 A1 Aug. 20, 2015

(51) Int. Cl.

| | |
|---|---|
| ***A45C 3/12*** | (2006.01) |
| ***A45C 7/00*** | (2006.01) |
| *A45C 13/10* | (2006.01) |

(52) U.S. Cl.

CPC ..... *A45C 3/12* (2013.01); *A45C 7/0086* (2013.01); *A45C 13/103* (2013.01)

(58) Field of Classification Search

CPC ..... A45C 3/12; A45C 7/0086
USPC ..... 383/37; 150/111, 117; 190/108, 110, 190/903; 206/278
See application file for complete search history.

(56) References Cited

U.S. PATENT DOCUMENTS

| | | | | |
|---|---|---|---|---|
| 915,452 | A * | 3/1909 | Litts | 220/577 |
| 2,276,765 | A | 3/1942 | De Gree | |
| 2,339,643 | A | 11/1943 | Donnellan | |
| 2,493,506 | A | 1/1950 | Schwartzbard | |
| 3,061,057 | A | 10/1962 | Miller | |
| 3,143,153 | A * | 8/1964 | Smith | 383/22 |
| 3,537,628 | A * | 11/1970 | Thompson | A01K 97/06 224/609 |
| 3,726,329 | A | 4/1973 | Dean | |
| 4,083,483 | A | 4/1978 | Bayless | |
| 4,696,403 | A | 9/1987 | Hoover | |
| 4,756,394 | A | 7/1988 | Cohen | |
| 4,795,030 | A * | 1/1989 | Boyce | G10G 7/005 190/108 |
| 5,018,876 | A | 5/1991 | Mennella | |
| 5,050,713 | A | 9/1991 | Lee | |
| 5,129,560 | A * | 7/1992 | Herman | 224/579 |
| 5,209,279 | A | 5/1993 | Wilson | |
| 6,142,670 | A | 11/2000 | Kramer | |
| 6,869,219 | B1 | 3/2005 | Sala | |
| 7,322,477 | B2 | 1/2008 | Schweitz | |
| D634,931 | S * | 3/2011 | Terrell | D3/289 |
| 8,496,106 | B1 * | 7/2013 | Bigg | 206/38 |
| D703,440 | S * | 4/2014 | Terrell | D3/289 |
| 2004/0163279 | A1 * | 8/2004 | Gadson et al. | 36/7.1 R |
| 2006/0233467 | A1 * | 10/2006 | Mize, Jr. | 383/37 |
| 2007/0039841 | A1 | 2/2007 | Deloatch-Ratliff | |
| 2007/0116384 | A1 * | 5/2007 | Mason | 383/9 |
| 2007/0181451 | A1 * | 8/2007 | Jones | 206/278 |
| 2007/0204483 | A1 * | 9/2007 | Kirsch et al. | 36/11.5 |
| 2007/0272570 | A1 * | 11/2007 | Brooks | 206/315.9 |

(Continued)

FOREIGN PATENT DOCUMENTS

GB 2501807 A * 11/2013

*Primary Examiner* — Sue A Weaver
(74) *Attorney, Agent, or Firm* — Memminger E. Wiggins

(57) ABSTRACT

A shoe bag for transporting a pair of shoes comprising two individual compartments. The compartments are detachable from one another and include an interior protective lining. Each detachable compartment has its own opening that can be opened or closed independently from the opening for the other compartment. The detachable compartments allow more efficient packing of the shoes within the luggage's interior and also protect the shoes from each other and also prevents the shoes from soiling items packed in the luggage.

13 Claims, 4 Drawing Sheets

(56) References Cited

U.S. PATENT DOCUMENTS

| | | | | |
|---|---|---|---|---|
| 2008/0011567 | A1* | 1/2008 | Hammond | 190/108 |
| 2008/0128231 | A1 | 6/2008 | Newman | |
| 2010/0142862 | A1* | 6/2010 | Sam | B65D 31/12 383/38 |
| 2011/0101052 | A1* | 5/2011 | Armstrong | 224/254 |
| 2012/0128271 | A1* | 5/2012 | Dias | 383/25 |

* cited by examiner

SHOE BAG

RELATED APPLICATIONS

Not Applicable.

STATEMENT AS TO RIGHTS TO INVENTIONS MADE UNDER FEDERALLY SPONSORED RESEARCH AND DEVELOPMENT

Not Applicable.

PARTIES TO A JOINT RESEARCH AGREEMENT

Not Applicable.

SEQUENCE LISTING

Not Applicable.

FIELD OF THE INVENTION

This invention is directed towards a shoe bag for the transportation of pairs of shoes, and more particularly to the storage of pairs of shoes in luggage when traveling. Additionally, the shoe bag can be separated into its individual compartments to facilitate the packing and arrangement of the individual shoe bag compartments with the other items packed in the luggage.

BACKGROUND OF THE INVENTION

There is only a finite amount of space available within an article of luggage when packing in preparation of travel. With the restrictions and costs now placed on the number, weight, and size of luggage by the various providers of commercial transportation, it becomes very important to utilize the limited space available for packing within the luggage interior as efficiently as possible. Although items such as clothing are easily conformed to the interior shape of a piece of luggage by folding, this is not the case when packing items not capable of being folded. Additionally, there is normally very little concern regarding the possibility of adjacently packed items of clothing harming, damaging, or soiling the other items packed within the luggage's interior.

Some of the more problematic items to pack when traveling are items of footwear. While some articles of luggage may contain built-in compartments for shoes, such compartments are limited in number and are not efficient with respect to the limited area available for packing which ultimately adds to the bulkiness of the luggage once the shoes are packed. Additionally, the interior of such luggage compartments are not normally constructed in such a manner as to provide any protection to a shoe's finish or to prevent damage due to the shoes coming into contact with each other. Although other devices also provide for the storage of shoes as pairs, or individually, these devices are often bulky and/or exist in a single configuration. Although there are devices designed to address the storage of shoes in some form or fashion, none have addressed the need of efficiently packing a pair, or pairs, of shoes in the limited confines of luggage when traveling. Accordingly, there remains room for improvement and variation within the art.

SUMMARY OF THE INVENTION

It is at least one of the present embodiments to provide a shoe bag that addresses the limited space constraints of luggage when packing items footwear for traveling. A shoe bag is provided having features of the present invention comprising a first compartment detachably secured to a second compartment in coplanar adjacent relation. Each of the shoe bag compartments comprises an outer edge, an inner edge, a bottom edge, a top edge defining an opening, and an interior protective lining. An attaching means is affixed to the inner edge of each compartment for detachably securing the first compartment to the second compartment. To secure the shoes within the shoe bag compartments a first closing means is operatively associated with the top edge and the opening of the first compartment. Likewise, a second closing means is operatively associated with the top edge and the opening of the second compartment. The first closing means is affixed to the top edge of the first compartment and the second closing means is affixed to the top edge of the second compartment. To improve holding of the shoe bag a first loop strap is attached to the top edge of the first compartment and a second loop strap is attached to the top edge of the second compartment of the shoe bag.

It is a further aspect of at least one of the present embodiments to provide a zipper affixed to the inner edges of each compartment as an attaching means to detachably secure the first compartment to the second compartment. Additionally, a hook and loop fastener, a plurality of snap fasteners, a lacing string, or a combination of these items may be used as the attaching means.

It is a further aspect of at least one of the present embodiments to provide a zipper affixed to each of the top edges of the first and second compartments to serve as the first and second closing means, respectively. Additionally, a hook and loop fastener, a plurality of snap fasteners, a lacing string, or a combination of these items may be used as the first and second closing means.

It is a further aspect of at least one of the present embodiments to provide a shoe bag having first and second compartments that are mirror images of each with regard to their respective sizes and shapes.

It is a further aspect of at least one of the present embodiments to provide a shoe bag having a first compartment and a second compartment wherein each compartment further includes an interior protective lining to protect the shoes when packed for traveling.

It is a further aspect of at least one of the present embodiments to provide a shoe bag having an interior protective lining being comprised of a non-abrasive material such as soft cotton, fleece, nylon, and the like.

It is a further aspect of at least one of the present embodiments to provide a shoe bag wherein the first compartment and the second compartment are each configured to receive a single shoe.

These and other features, aspects, and advantages of the present invention will become better understood with reference to the following description and appended claims.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE INVENTION

Reference will now be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. Thus, it is intended that the present invention cover such modifications and variations as come within the scope of the appended claims and their equivalents. Other objects, features, and aspects of the present invention are disclosed in the following detailed description. It is to be understood by one of ordinary skill in the art that the present discussion is a description of exemplary embodiments only and is not intended as limiting the broader aspects of the present invention, which broader aspects are embodied in the exemplary constructions.

Figure 1:
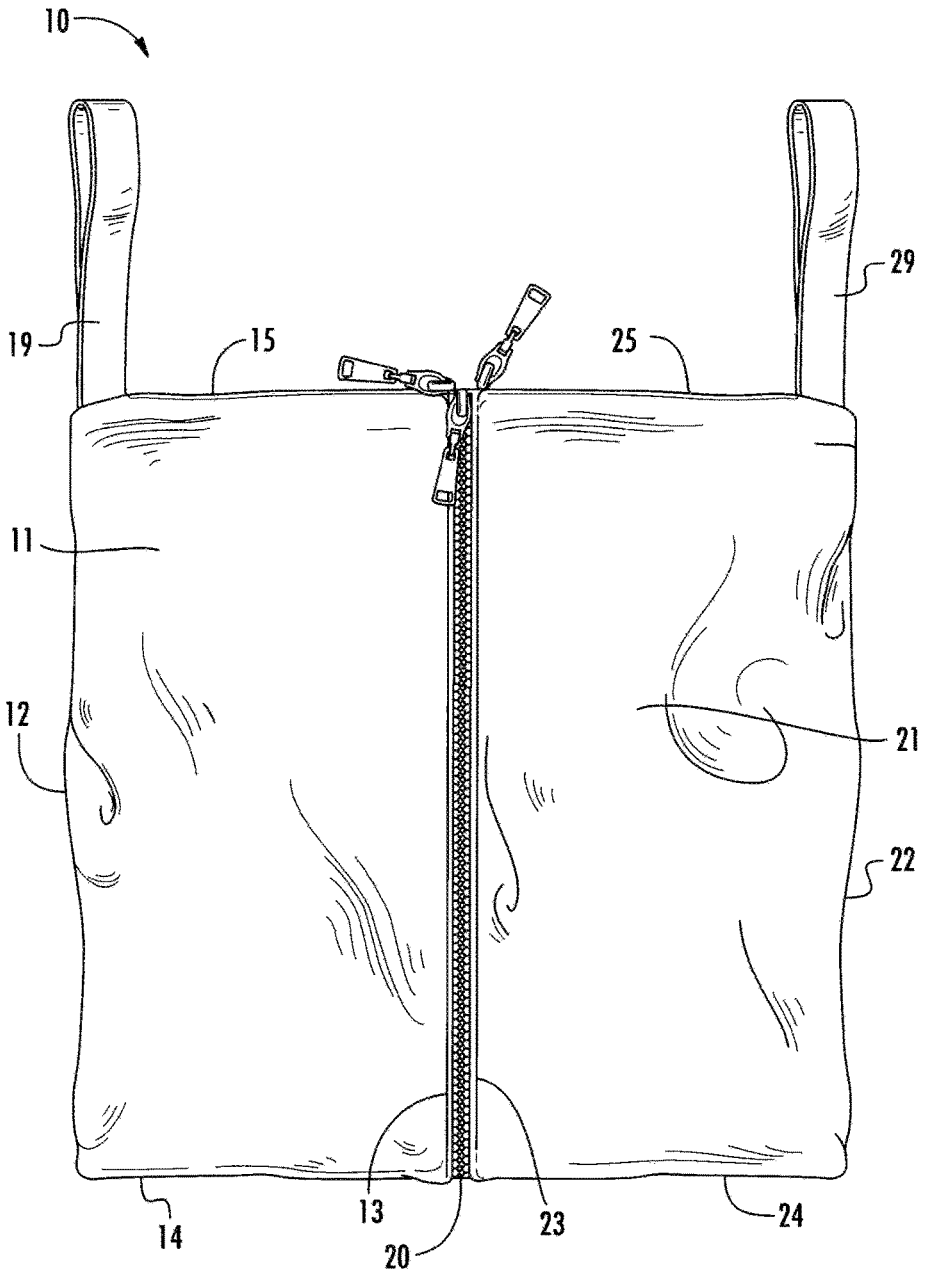
FIG. 1 is a plan view of the shoe bag illustrating the compartments attached to each other.
Figure 2:
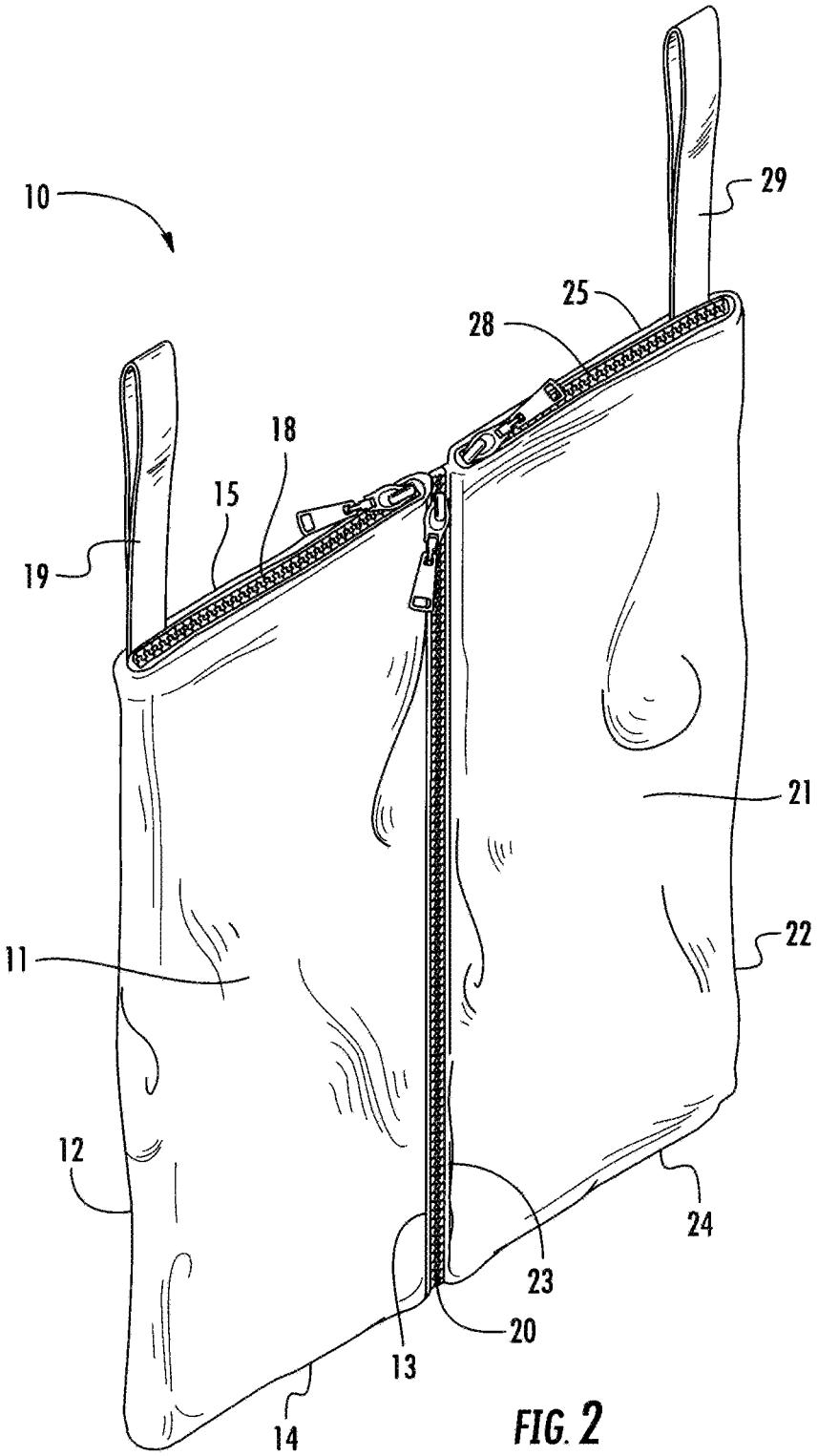
FIG. 2 is perspective view of the shoe bag illustrating the compartments attached to each other.

As seen in reference to FIGS. 1 to 4, a shoe bag 10 is provided in accordance with one exemplary embodiment of the present invention. FIG. 1 and FIG. 2 show a shoe bag comprising two separate compartments, a first compartment 11, and a second compartment 21 that are detachably secured to each other in a coplanar adjacent relation. Each compartment has an outer edge 12, 22, an inner edge 13, 23, a bottom edge 14, 24, and a top edge 15, 25. Additionally, each compartment of the shoe bag also has a top opening 16, 26 located at its top edge and an interior protective lining 17, 27 which are clearly illustrated in FIG. 4. Other embodiments of the present invention may include a shoe bag with the opening for each compartment located along the compartment's outer edge, bottom edge, or inner edge.

Figure 3:
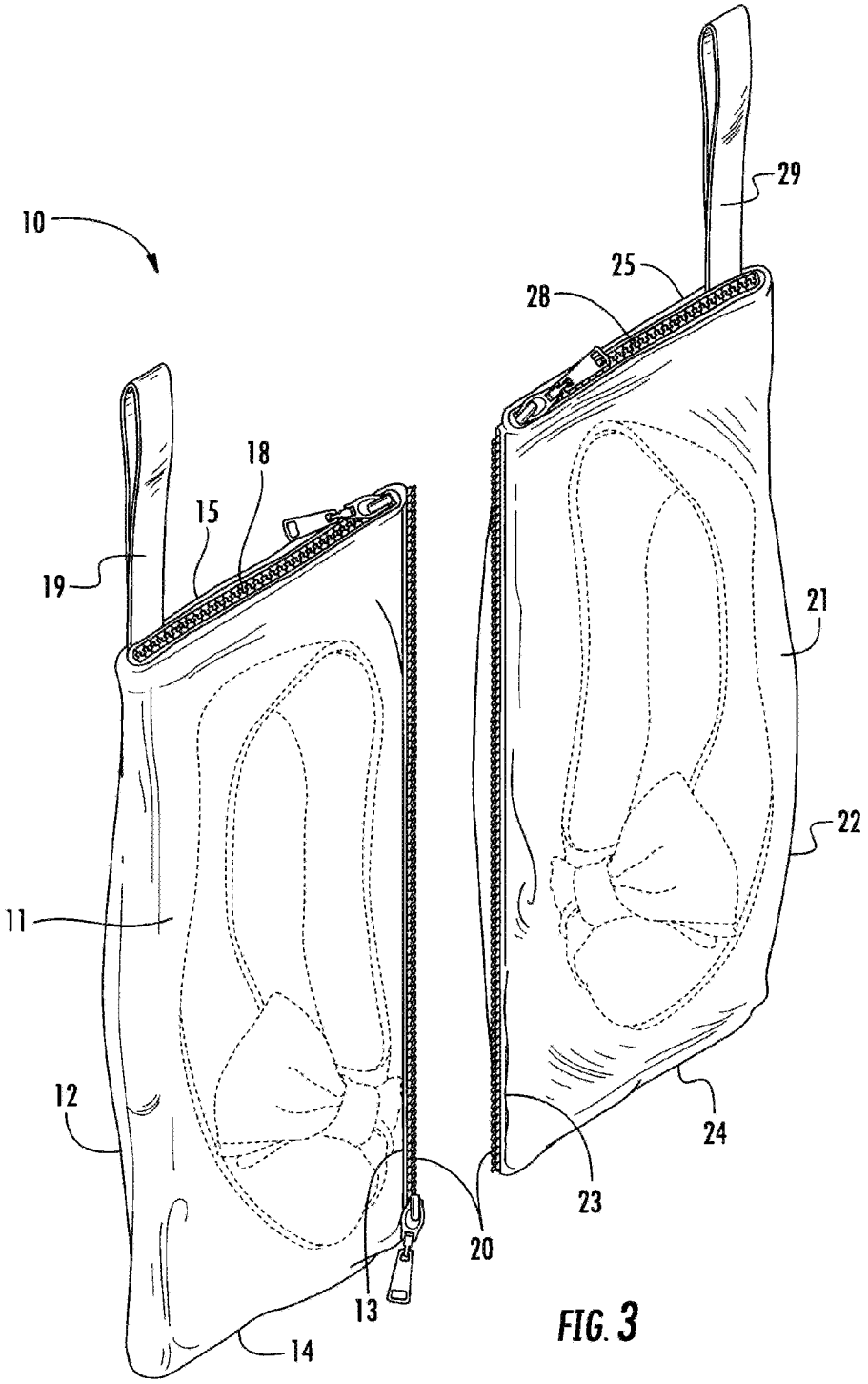
FIG. 3 is a perspective view of the shoe bag with its compartments detached from each other with a shoe being depicted by dotted lines in each compartment.
Figure 4:
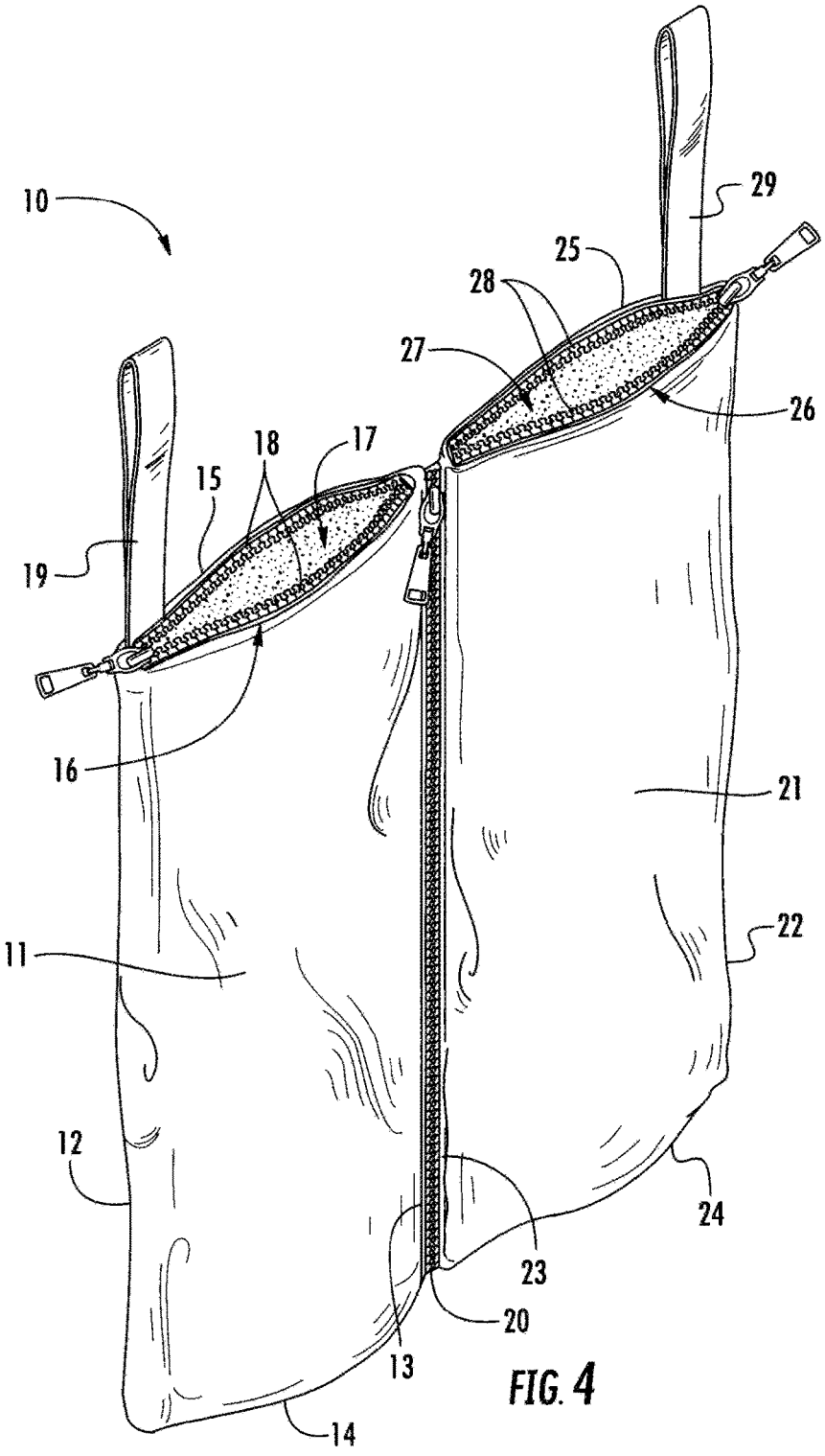
FIG. 4 is a perspective view of the shoe bag illustrating attached compartments in their open configuration.

Referring to FIGS. 1, 2, and 4, an attaching means 20 is affixed to the inner edge 13, 23 of each compartment 11, 21. Such an attaching means permits the shoe bag to exist in two different configurations. One configuration is with both compartments 11, 21 secured to each other which is shown in FIGS. 1, 2, and 4. As shown in FIG. 3, the second configuration is with the shoe bag compartments 11, 21 detached from each other. The shoe bag provides an important organizational feature in which both shoes of a pair are conveniently secured within each shoe's respective compartment when the shoe bag is configured with compartments 11, 21 detachably secured to each other. Additionally, another important feature of the present invention is the ability to separate the shoe bag 10 into its separate compartments 11, 21 which facilitate packing a pair of shoes when interior luggage space is limited. The attaching means 20 used to detachably secure the shoe bag compartments 11, 21 to one another is preferably a zipper with each side of the zipper being attached to the inner edge of each compartment such that a zipper slide can engage or disengage the zipper sides as desired. As seen, the zipper or other attachment means is not in direct communication with the interior volume of the respective compartments or pouches 11, 21. Such a physical separation of the bag interior from the zipper or attachment prevents damage to a shoe placed within the bag. However, any attaching means known capable of providing a detachably secured configuration for two or more components can be used. Other embodiments of the present invention may include attaching means comprising a hook and loop fastener, a plurality of snap fasteners, a lacing string, or a combination thereof. As shown in FIGS. 1 to 4, loop straps 19, 29 are attached to the top edges 15, 25 of each compartment 11, 21 where the top edges 15, 25 meet the outer edges 12, 22. The loop straps 19, 29 facilitate holding the shoe bag regardless of whether the compartments are secured to each other or detached into separate compartments. As seen in reference to the Figures, the loop straps 19, 29 may be secured to the upper bag edges in a manner that does not interfere with the illustrated zipper closures. In other embodiments of the present invention the loop straps 19, 29 may be attached at other positions on the compartments 11, 21 and the loop straps may be configured to be permanently attached to the shoe bag compartments or detachably secured by such attaching means known to permit a detachably secured configuration between two separate components.

Now referring to FIGS. 2, 3, and 4, to secure the first shoe of a pair within the interior of the first compartment a first closing means 18 is operatively associated with the top edge 15 and the top opening 16 of the first compartment 11 of the shoe bag 10. Additionally, to secure the second shoe of a pair within the interior of the second compartment a second closing means 28 is operatively associated with the top edge 25 and the top opening 26 of the second compartment 21. Referring to FIG. 4, the top opening 16, 26 of each compartment includes a top edge 85,25 to which the first closing means 18 and the second closing means 28 are affixed. The first closing means 18 and the second closing means 28 used to open and close the shoe bag compartments 11, 21 is preferably a zipper wherein each side of the zipper extends along the top edge of its compartment such that a zipper slide can be engaged to either close the compartment to secure its shoe or to provide access to such compartment for removal of the shoe. However, any closing means known capable of securing a shoe within the shoe bag compartments 11, 21 can be used. Other embodiments of the present invention may include closing means comprising a hook and loop fastener, a plurality of snap fasteners, magnetic clasps and closures, a lacing string, a draw string, or a combination thereof.

As shown in FIGS. 1, 2, and 3, the first compartment 11 and the second compartment 21 are a mirror image to each other with regard to the size and shape of each compartment. Additionally, each compartment 11, 21 is configured to receive a single shoe. The preferred size of each compartment 11, 21 is about 8 ¼ inches to about 11 inches in width and about 15 ½ inches to about 20 inches in length. Other embodiments of the present invention may include compartments 11, 21 that are manufactured in smaller or larger sizes in order to accommodate the smaller shoes worn by young children or the larger shoes worn for outdoor activities or athletic events. Referring to FIGS. 1 to 4, the preferred shape of each compartment 11, 21 is rectangular in order to minimize manufacturing costs by reducing raw material waste. The compartments may be constructed in other shapes to accommodate special use footwear provided such shapes are a mirror image of each other and provide common inner edges 13, 23 upon which to affix an attaching means 20. Referring to FIG. 4, each compartment 11, 21 includes an interior protective lining 17, 27. The interior protective linings 17, 27 provide extra protection to a shoe's finish while the shoe is secured within a compartment. The interior protective linings 17, 27 are made of any suitable non-abrasive material which may be a natural fabric or man-made synthetic material, such as for example, soft cotton cloth, fleece, or nylon.

In use, each of the shoe bag compartments 11, 21 receive a single shoe of a specific pair of shoes. To prevent the shoes from escaping from their respective compartments 11, 21 the closing means 18, 28 for each compartment is engaged as necessary to close the compartment and therefore secure the shoe within its compartment 11, 21. If there is adequate space available within the luggage interior, the shoe bag can be packed with its compartments 11, 21 detachably secured to each other. However, if there is limited packing space within the luggage interior, the shoe bag compartments 11, 21 can be detached from each other by disengaging the attaching means 20 and packing each compartment separately in different areas within the luggage's interior. In addition to the shoe bag's use for traveling, it can also be used for the general storage of pairs of shoes. Due to the simple design and construction of the shoe bag, it can be easily stored in a minimum amount of space when not in use.

Accordingly, a feature and advantage of the present invention is its ability to be configured with its compartments secured to each other or with its compartments detached from each other in order to efficiently maximize the limited packing space within the interior confines of luggage when traveling.

Another feature and advantage of the present invention is its simple design which permits it to be manufactured easily and inexpensively from a variety of materials.

Still another feature and advantage of the present invention is its ability to have decorative designs applied to its compartments.

Another feature and advantage of the present invention is its ability to be manufactured with compartments of different shapes and sizes to accommodate different kinds of footwear.

Another feature and advantage of the present invention is its ability to be used for the general storage of a pair of shoes.

Another feature and advantage of the present invention is its ability to be washed if it becomes dirty or soiled with use.

Yet another feature and advantage of the present invention is its ability to be easily and compactly stored when not in use.

Yet another feature and advantage of the present invention is its ability to be manufactured in different colors, with different exterior decorative designs, patterns, or materials to visually identify specific pairs of shoes when traveling or during storage of the shoes.

Another feature and advantage of the present invention is its ability to prevent packed shoes from damaging or soiling each other and from damaging or soiling other items packed within the luggage's interior.

Although preferred embodiments of the invention have been described using specific terms, devices, and methods, such description is for illustrative purposes only. The words used are words of description rather than of limitation. It is to be understood that changes and variations may be made by those of ordinary skill in the art without departing from the spirit or the scope of the present invention. In addition, it should be understood that aspects of the various embodiments may be interchanged, both in whole, or in part. Therefore, the spirit and scope of the invention should not be limited to the description of the preferred versions contained herein.

That which is claimed:

1. A shoe bag comprising:

a first compartment and a second compartment, said first compartment being detachably secured to said second compartment in coplanar adjacent relation;

each said compartment comprising a closed outer edge, a closed inner edge, a closed bottom edge, and a top edge defining an opening for insertion of a shoe;

an attaching means affixed to each said closed inner edge for detachably securing said first compartment to said second compartment;

a first closing means operatively associated with said top edge of said first compartment;

a second closing means operatively associated with said top edge of said second compartment; and a first loop strap attached to said top edge of said first compartment and a second loop strap attached to said top edge of said second compartment.

2. The shoe bag of claim 1, wherein said attaching means comprises a zipper affixed to said closed inner edge of the first compartment and to said closed inner edge of the second compartment detachably securing said first compartment to said second compartment.

3. The shoe bag of claim 1, wherein said first closing means is affixed to said top edge of said first compartment.

4. The shoe bag of claim 1, wherein said second closing means is affixed to said top edge of said second compartment.

5. The shoe bag of claim 1, wherein said first and second closing means each comprise a zipper affixed to said top edge of said first compartment and to said top edge of said second compartment.

6. The shoe bag of claim 1, wherein said first compartment being a mirror image to said second compartment in size and shape.

7. The shoe bag of claim 1, wherein said first compartment and said second compartment each are configured for receiving a single shoe.

8. A shoe holder comprising:

a first pouch defining an interior volume and having a re-closeable opening defining a first zipper along an upper edge of the pouch;

a second pouch defining an interior volume and having a re-closeable opening defining a second zipper along an upper edge of the pouch;

a third zipper connecting a length portion of the an exterior of the first pouch to a length portion of an exterior of the second pouch;

a first loop handle secured to the re-closeable opening of the first pouch; and a second loop handle secured to the re-closeable opening of the second pouch, the first and second loop handles secured to the respective first and second pouches in a location remote from the respective first and second zippers.

9. A method of using a shoe bag having a first compartment detachably secured to a second compartment in coplanar adjacent relation, wherein each said compartment comprising a closed outer edge, a closed inner edge, a closed bottom edge, and a top edge defining an opening for the insertion of a shoe;

an attaching means affixed to each said closed inner edge for detachably securing said first compartment to said second compartment;

a first closing means operatively associated with said top edge of said first compartment and a second closing means operatively associated with said top edge of said second compartment; and a first loop strap attached to said top edge of said first compartment and a second loop strap attached to said top edge of said second compartment;

said method comprising:

inserting a first shoe of a pair of shoes into said first compartment;

inserting a second shoe of said pair of shoes into said second compartment; and closing said first compartment and said second compartment by engaging said first and second closing means to secure said first and second shoes inside respective said first and second compartments.

10. The method of claim 9, wherein said attaching means having a zipper affixed to said closed inner edge of the first compartment and to said closed inner edge of the second compartment said closing comprises engaging said zipper to detachably secure said first compartment to said second compartment.

11. The method of claim 9, wherein said first closing means is affixed to said top edge of said first compartment and said closing said first compartment comprises engaging said first closing means.

12. The method of claim 9, wherein said second closing means is affixed to said top edge of said second compartment and said closing said second compartment comprises engaging said second closing means.

13. The method of claim 9, wherein said first and second closing means each comprise a zipper affixed to said top edge of said first compartment and to said top edge of said second compartment and said closing of said first and said second compartments comprises closing said zipper.

* * * * *